US011280126B2

(12) United States Patent
Seppänen et al.

(10) Patent No.: US 11,280,126 B2
(45) Date of Patent: Mar. 22, 2022

(54) DOOR CLOSER ARRANGEMENT

(71) Applicant: Abloy Oy, Joensuu (FI)

(72) Inventors: Sauli Seppänen, Joensuu (FI); Juhani Karvonen, Kuopio (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 16/992,733

(22) Filed: Aug. 13, 2020

(65) Prior Publication Data

US 2021/0071457 A1 Mar. 11, 2021

(30) Foreign Application Priority Data

Sep. 5, 2019 (EP) ..... 19195635

(51) Int. Cl.
*E05F 3/20* (2006.01)
*E05F 3/22* (2006.01)
*E05F 1/08* (2006.01)

(52) U.S. Cl.
CPC ..... *E05F 3/22* (2013.01); *E05F 1/08* (2013.01); *E05Y 2900/132* (2013.01)

(58) Field of Classification Search
CPC ..... E05C 17/02; E05C 17/54; E05C 17/34; E05C 17/32; E05F 3/22; E05F 3/221; E05F 3/227; E05F 1/08; E05F 2003/228; E05Y 2900/132; Y10T 16/469; Y10T 16/459; Y10T 16/462
See application file for complete search history.

(56) References Cited

U.S. PATENT DOCUMENTS 1,190,324 A 7/1916 Rogers
2,013,418 A * 9/1935 Moore ..... E05C 17/32 292/263
2,171,065 A * 8/1939 Johnson ..... E05C 17/22 292/278
2,960,718 A * 11/1960 Lasier ..... E05F 3/22 16/49
3,259,936 A * 7/1966 Sheridan ..... E05C 17/32 16/49
3,260,545 A * 7/1966 Check ..... E05C 17/32 292/263

(Continued)

FOREIGN PATENT DOCUMENTS

DE 3844995 C2 7/2003
JP 2006052534 A * 2/2006

*Primary Examiner* — Chuck Y Mah
(74) *Attorney, Agent, or Firm* — Muncy, Geissler, Olds & Lowe, P.C.

(57) ABSTRACT

The invention comprises a door closer (1), a slide rail (3) and an arm (2). The arm is connected to the door closer (1) and to the slide rail (3). The slide rail is provided with a hold open device (4) in order to keep a door open. The arm (2) comprises an outer arm (8A, 9A) and an inner arm (8B, 9B). The inner is situated partly inside the outer arm in a sliding manner. The arm (2) also comprises a spring arrangement (11) in order to hold the inner arm (8B, 9B) in a normal position in the outer arm (8A, 9A), and a release device (10A, 10B). The release device is arranged to release the inner arm (8B, 9B) from its normal position when an external force being strong enough to active a release of the release device (10A, 10B) drives the inner arm (8B, 9B) out from the outer arm (8A, 9A).

15 Claims, 6 Drawing Sheets

(56) References Cited

U.S. PATENT DOCUMENTS

| | | | | | |
|---|---|---|---|---|---|
| 4,329,917 | A * | 5/1982 | Fisher | B60H 1/262 | 454/94 |
| 4,419,787 | A * | 12/1983 | Lieberman | E05F 1/1008 | 16/65 |
| 4,491,355 | A * | 1/1985 | Marinoni | E05C 17/34 | 292/263 |
| 4,506,407 | A * | 3/1985 | Downey | E05F 3/222 | 16/320 |
| 4,564,973 | A | 1/1986 | Kordes | | |
| 4,759,099 | A | 7/1988 | Morano et al. | | |
| 4,837,890 | A * | 6/1989 | Tully | E05C 17/28 | 16/71 |
| 4,858,272 | A * | 8/1989 | Ogawa | E05F 3/221 | 16/80 |
| 5,448,798 | A * | 9/1995 | Coleman | E05C 17/28 | 16/85 |
| 5,901,992 | A * | 5/1999 | Winkler | E05C 17/28 | 292/270 |
| 5,930,954 | A * | 8/1999 | Hebda | E05F 15/63 | 49/345 |
| 6,253,417 | B1 * | 7/2001 | Rusiana | E05C 17/28 | 16/65 |
| 7,192,105 | B2 * | 3/2007 | Jung | E05D 11/1064 | 312/405 |
| 8,959,710 | B2 * | 2/2015 | Wach | E05C 17/16 | 16/82 |
| 9,388,618 | B2 * | 7/2016 | Hoffman | E05F 3/04 | |
| 2006/0244271 | A1 | 11/2006 | Hass | | |
| 2021/0071458 | A1 * | 3/2021 | Eickhoff | E05F 3/227 | |

* cited by examiner

DOOR CLOSER ARRANGEMENT

FIELD OF TECHNOLOGY

The invention relates to a door closer arrangement having a door closer and a slide rail.

PRIOR ART

Known door closer arrangement may comprise a door closer, a slide rail and an arm wherein the arm is connected to the door closer and to the slide rail. The slide rail can be provided with a hold open device in order to keep a door open. Having the slide rail with the door closer, the arm is a straight member.

When a door is opened, the end of the arm, which is connected to the slide rail, slides along the slide rail. If it is desired to keep the door open, the slide rail can be provided with said hold open device. The angle where the door is kept open is usually 80-130 degrees. The hold open device prevents the door closer to close the door until the hold open device is released. The releasing can be done, for example, mechanically or electrically depending on the structure of the hold open device. The hold open device can have, for example, a mechanical release device, an electromagnetic release device, an electromechanical release device, or an electrohydraulic release device. The door closer arrangements with a release device in the slide rail are used, for example, at schools, kindergartens and retirement homes There are situations where the door, which is kept open, creates an obstacle for a desired passage through the door, for example when carrying large items. The hold open device may be overrun in order to open door more, but it causes extra stress to the hold open device and may not be so smooth for users. There are also hold open devices which cannot be overrun.

SHORT DESCRIPTION

The object of the invention is to alleviate or even eliminate the problems said above. The object is achieved in a way described in the independent claims. Dependent claims illustrate different embodiments of the invention.

A door closer arrangement according to the invention comprises a door closer 1, a slide rail 3 and an arm 2. The arm is connected to the door closer 1 at a first end 12 of the arm, and to the slide rail 3 at a second end 13 of the arm. The slide rail is provided with a hold open device 4 in order to keep a door open. The arm 2 comprises an outer arm 8A, 9A and an inner arm 8B, 9B. The inner is situated partly inside the outer arm in a sliding manner. The arm 2 also comprises a spring arrangement 11 in order to hold the inner arm 8B, 9B in a normal position in the outer arm 8A, 9A, and a release device 10A, 10B. The release device is arranged to release the inner arm 8B, 9B from its normal position when an external force being strong enough to active a release of the release device 10A, 10B drives the inner arm 8B, 9B out from the outer arm 8A, 9A. In other words, when the door is kept open by a hold open device 4, and the door is pushed/pulled to open more using enough force to activate the release of the release device, the inner arm can move out from the outer arm when the total length of the arm 2 increases and the door can be moved to a larger opening angle.

Therefore, there is more space to carry large items through the door opening, and the hold open device does not carry so much extra stress.

LIST OF FIGURES

In the following, the invention is described in more detail by reference to the enclosed drawings, where FIG. 1 illustrates an example of a door closer arrangement according to the invention, FIG. 2 illustrates an installation example of the door closer arrangement according to the invention, FIG. 3 illustrates an example of an arm for the door closer arrangement according to the invention, FIG. 4 illustrates a cut-away view of the arm of FIG. 4, FIG. 5 illustrates another cut-away view of the arm of FIG. 3.

Figure 8:
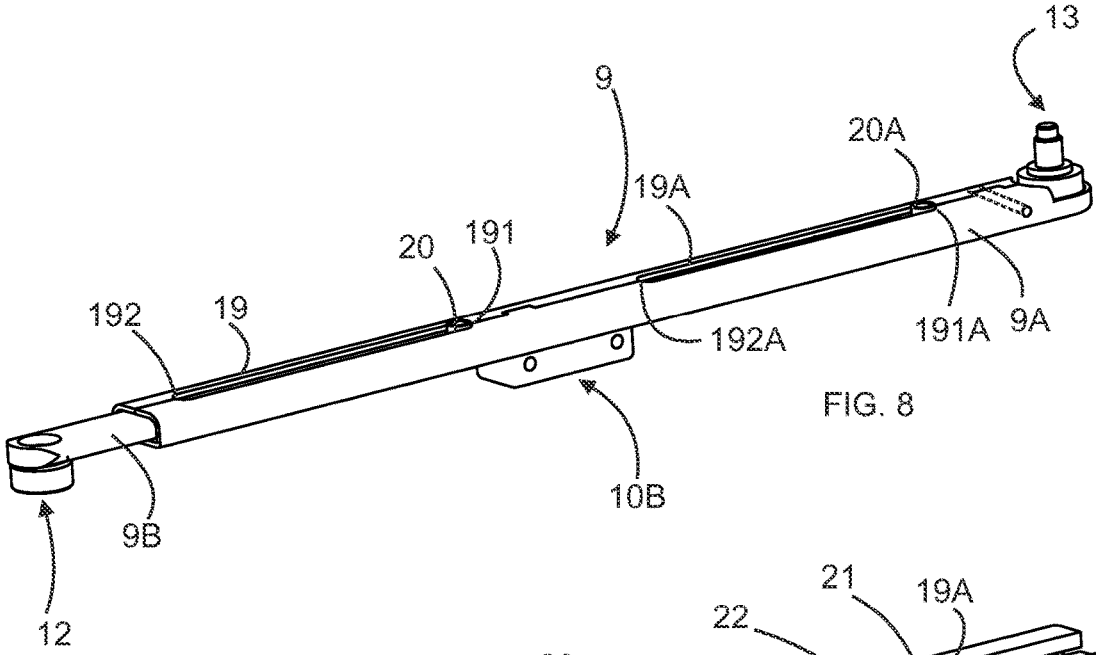
Figure 9:
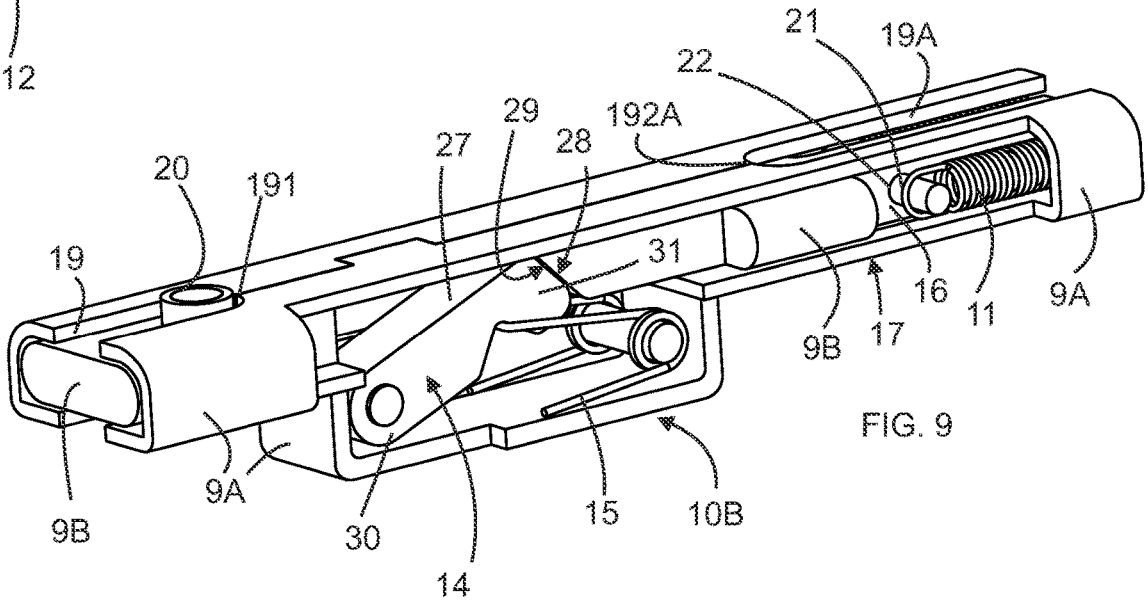
Figure 10:
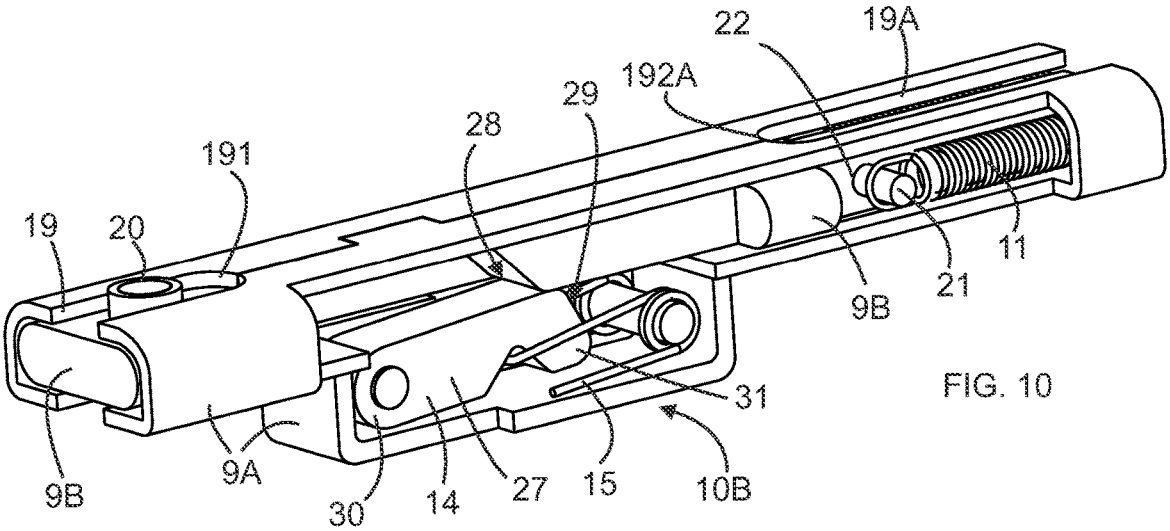
Figure 11:
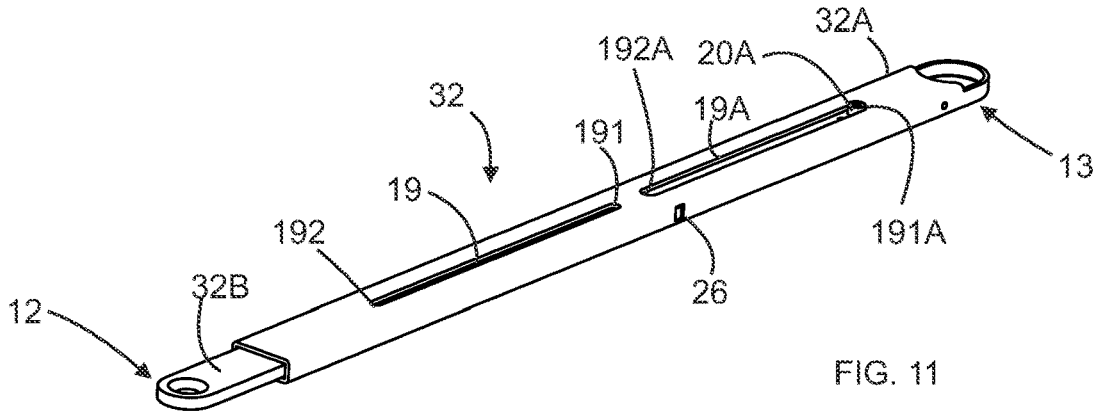
Figure 12:
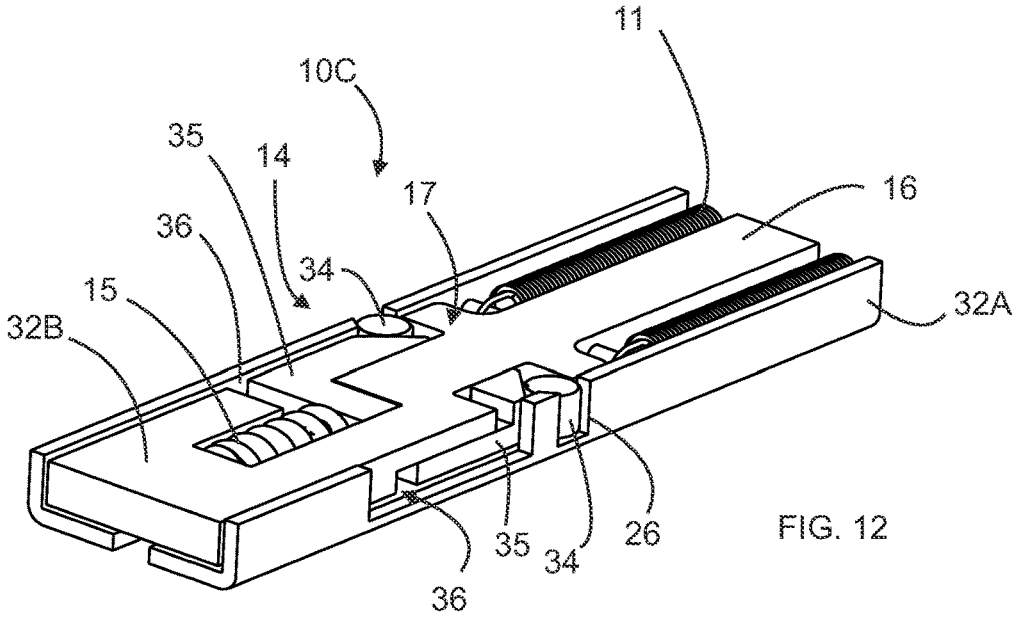
Figure 13:
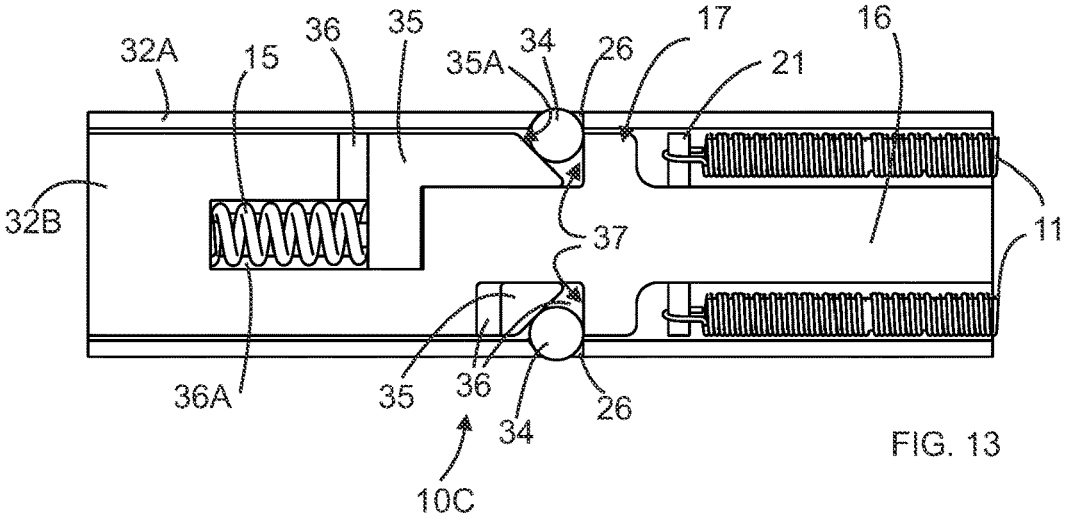
Figure 14:
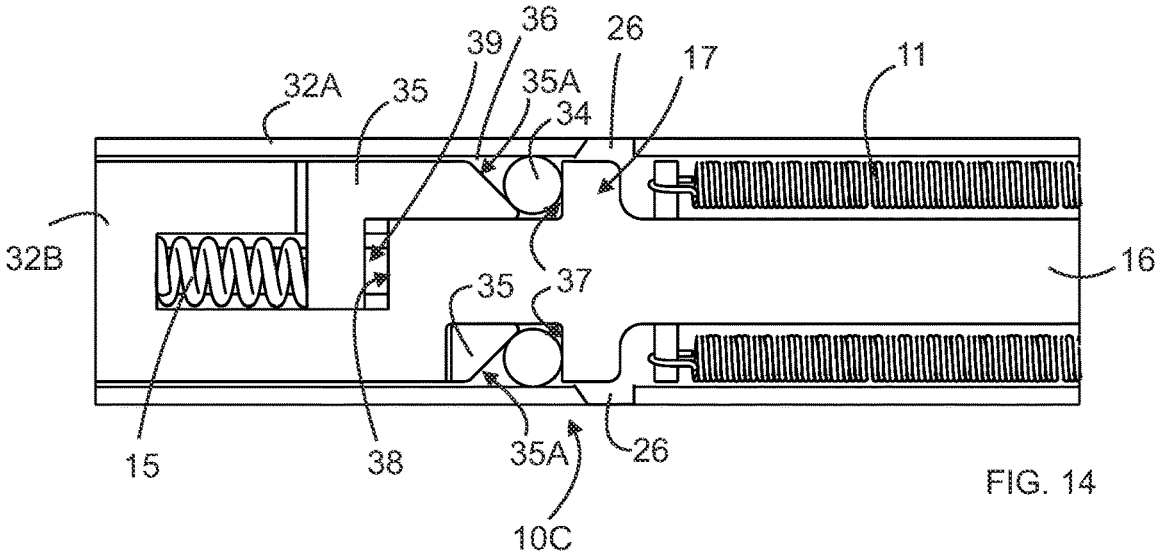
Figure 15:
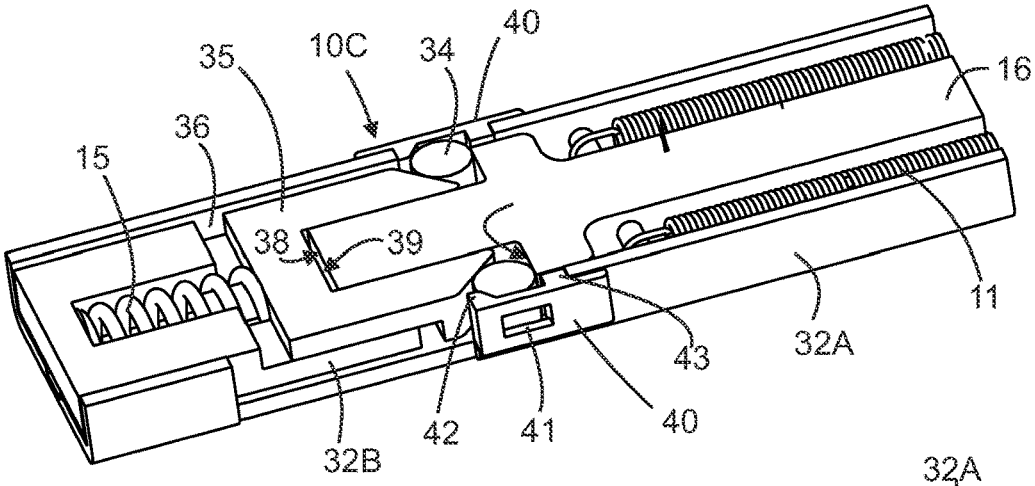
Figure 16:
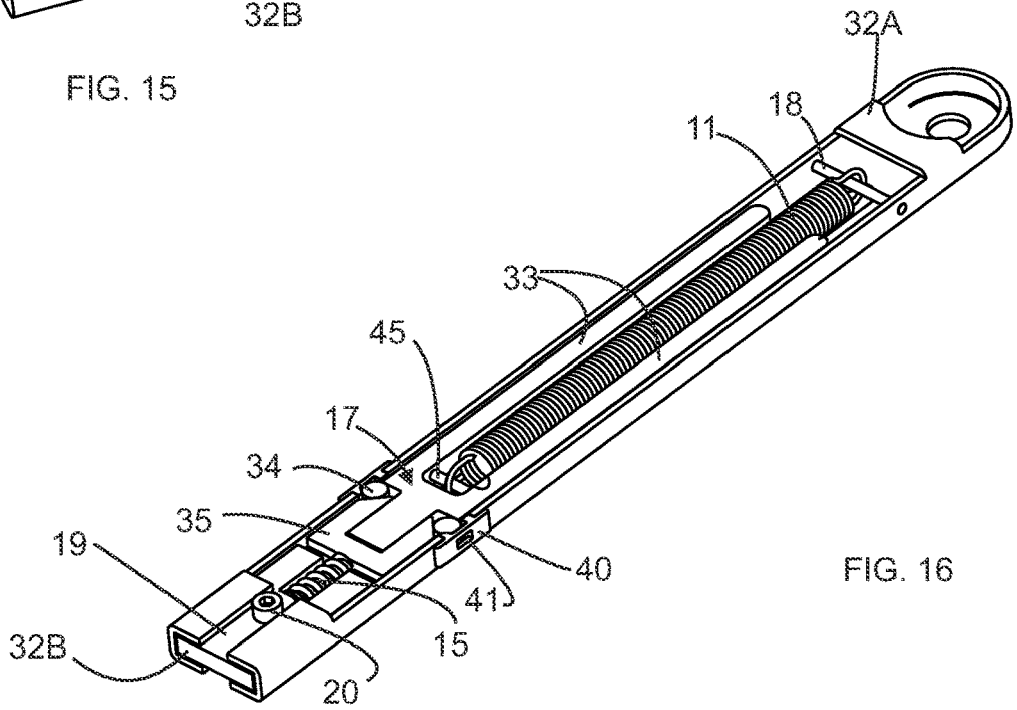

FIG. 8 illustrates another example of an arm for the door closer arrangement according to the invention, FIG. 9 illustrates a cut-away view of the arm of FIG. 8, FIG. 10 illustrates another cut-away view of the arm of FIG. 8, FIG. 11 illustrates a further example of the arm, FIG. 12 illustrates a cut-away view of the arm of FIG. 11, FIG. 13 illustrates another cut-away view of the arm of FIG. 11, FIG. 14 illustrates yet another cut-away view of the arm of FIG. 11, FIG. 15 illustrates another embodiment of the arm of FIG. 11, and FIG. 16 illustrates yet another embodiment of the arm.

DESCRIPTION OF THE INVENTION

Figure 1:
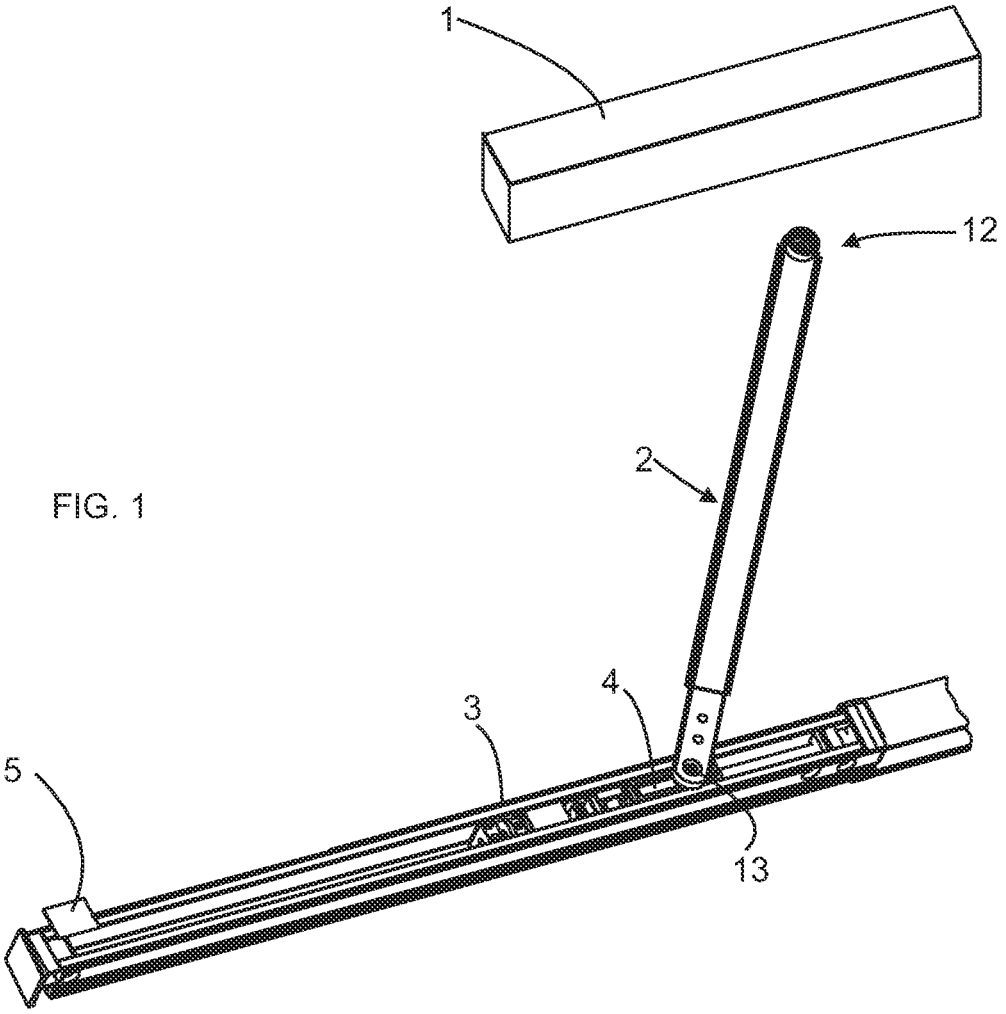
Figure 2:
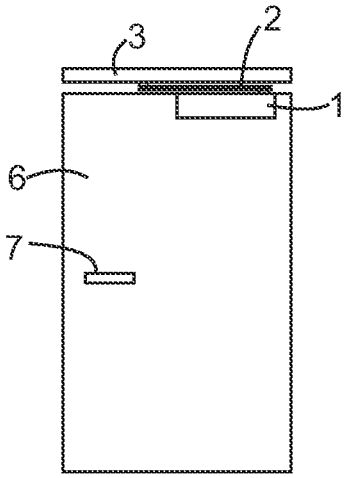

FIG. 1 illustrates an example of a door closer arrangement according to the invention. The door closer arrangement comprises a door closer 1, a slide rail 3 and an arm 2. The arm is connected to the door closer 1 at the first end 12 of the arm, and to the slide rail 3 at the second end 13 of the arm. A usual installation is that the door closer 1 is on the door 6 and the slide rail on a door frame (not showed in the figures), as can be seen in FIG. 2. FIG. 2 shows also a handle 7 of the door 6. It also possible that the door closer is on the door frame and the slide rail 3 on the door.

The slide rail 3 is provided with a hold open device 4 in order to keep a door open. As said the hold open device can, for example, be a mechanical, electromagnetic, electromechanical, or electrohydraulic device. A cover plate 5 is showed in an unfixed position in order to show insight to the slide rail. The arm 2 comprises an outer arm 8A, 9A and an inner arm 8B, 9B, which are showed in more detail in the other figures like in FIGS. 3 and 8.

Figure 3:
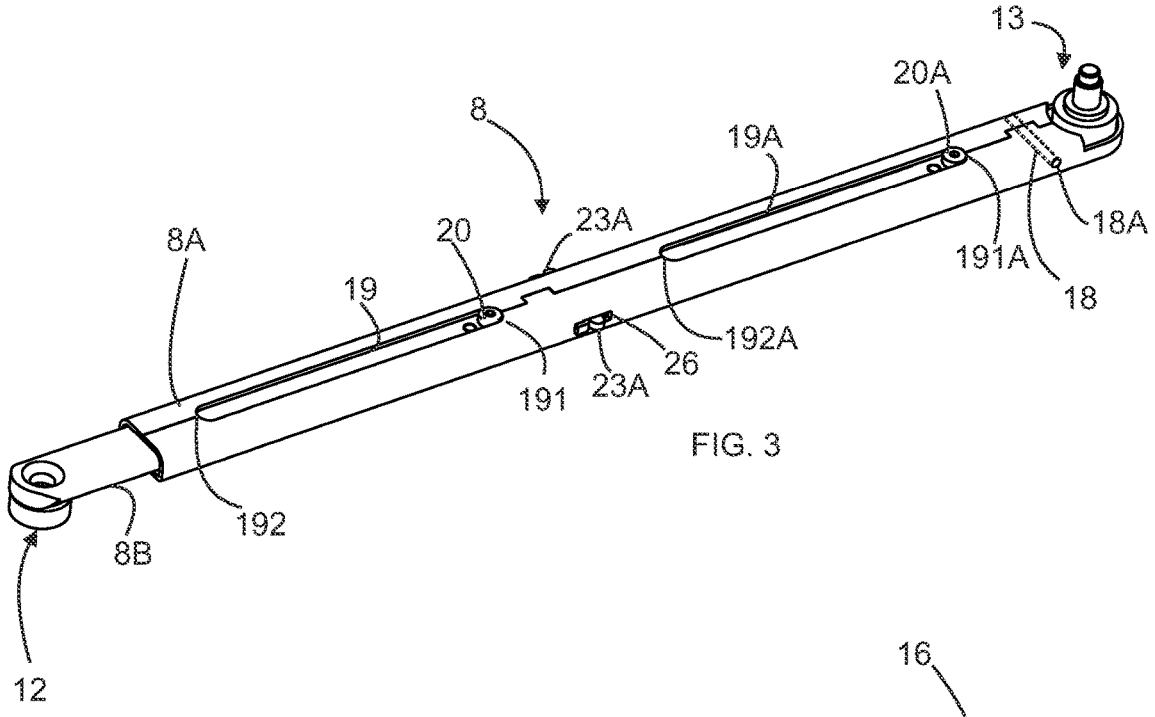

FIG. 3 illustrates an example of an arm 8 for the door closer arrangement according to the invention. FIG. 8 shows another example of the arm 9. The inner arm 8B, 9B is situated partly inside the outer arm in a sliding manner. The arm 2, 8, 9 also comprises a spring arrangement 11 in order to hold the inner arm 8B, 9B in a normal position in the outer arm 8A, 9A. The arm comprises also a release device 10A, 10B. FIG. 3 and also FIG. 8 illustrates the normal position. In this position the whole length of the arm 2, 8, 9 is such that it keeps a door open at a designed angle like 90-120 degrees.

The release device 10A, 10B is arranged to release the inner arm 8B, 9B from its normal position when an external force is strong enough to active a release of the release device 10A, 10B. The external force exists for example when a door is pushed or pulled hard to be more open. FIGS.

4, 5, 7, 9 and 10 show embodiments of the release device 10A, 10B. As can be seen the release device can comprise a latch arrangement 14 and a latch spring arrangement 15, which are arranged to be in a holding position and to release the inner arm 8B, 9B, 32B from its normal position by said external force.

After the release device has been released the external force drives the inner arm 8B, 9B out from the outer arm 8A, 9A. In other words, when the door is kept open by a hold open device 4, and the door is pushed/pulled to open more using enough force to activate the release of the release device, the inner arm can move out from the outer arm when the total length of the arm 2 increases and the door can be moved to a larger opening angle. Therefore, there is more space to carry large items through the door opening, and the hold open device does not have so much extra stress because of the release function of the release device. In case where the hold open device cannot be overrun the extra stress, for example due to dashing towards the door or pushing forcibly the door, is fully carried by the hold open device.

Figure 6:
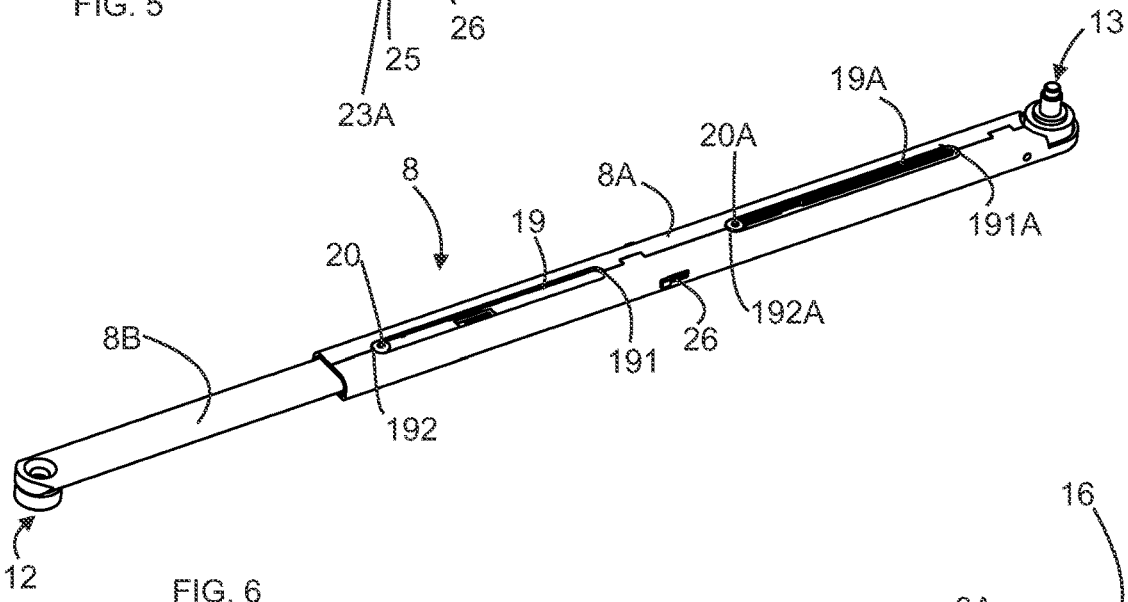
FIG. 6 illustrates the arm of FIG. 3 having a longer length.

It is worth to mention that the inner arm movement (sliding) out from the outer arm is restricted so that it does not slide totally out from the outer arm. FIG. 6 shows an example wherein the inner arm 8B has been released by the release device, the external force has moved it out from the outer arm 8A. As can be seen in FIGS. 6, 3 and 9, the inner arm 8B, 9B comprises at least one guiding extension 20, 20A in a transversal direction with respect to a longitudinal axis of the inner arm, and the outer arm 8A, 9A comprises at least one longitudinal hole 19, 19A wherein said guiding extension is situated. The guiding extension 20, 20A and the longitudinal hole 19, 19A guide and restrict the movement of the inner arm. The guiding extension can be a screw, which is attached to the inner arm. The end 192, 192A of the longitudinal hole determines how long the inner arm can slide out from the outer arm, and the other end 191, 191A may determine the normal position of the inner arm with the guiding extension.

The spring arrangement 11 comprises at least one spring. In an embodiment wherein the spring arrangement 11 comprises one spring (FIG. 16), and the inner arm 32B comprises two longitudinal extensions 33 at an inside end 17 of the inner arm, the spring is situated between the two extensions. The first end of the spring is connected to the inside end 17 of the inner arm or to the longitudinal extensions 33, utilizing for example a connection rod 45. The second end of the spring is connected to the outer arm via a connection part 18, which can also be a rod. The outer arm 8A, 9A can have holes 18A for the connection part 18.

In another embodiment wherein the spring arrangement 11 comprises two springs (FIG. 4, FIG. 9), and the inner arm 8B, 9B comprises a longitudinal extension 16 at an inside end 17 of the inner arm, the two springs are situated at both sides of the longitudinal extension. The first ends of the two springs are connected to the inside end 17 of the inner arm or to the extension, for example utilizing connection pin or pins 21, 22. The second ends of the two springs can be connected to the outer arm 8A, 9A via a connection part 18, which can be a rod. As can be seen in the figures, the longitudinal extension 16 may have one guiding extension 20A.

Figure 4:
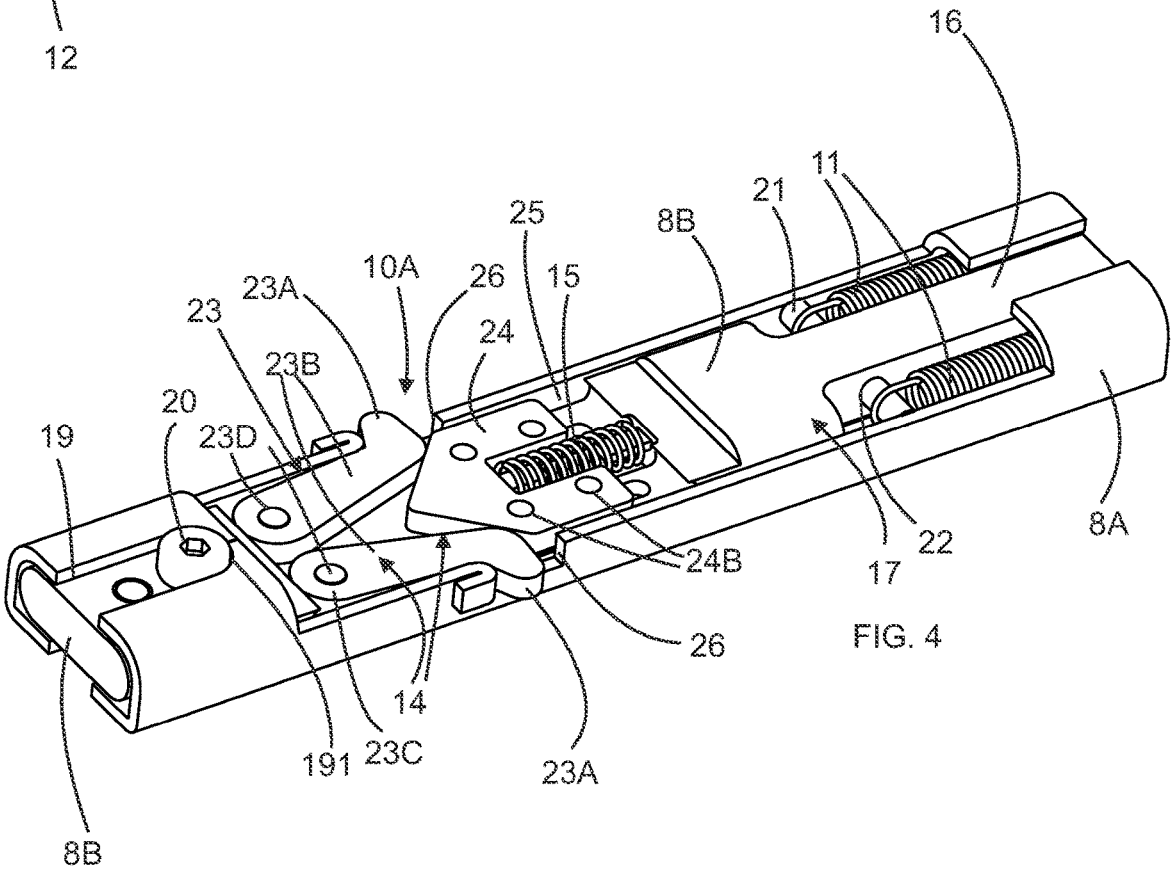

FIG. 4 illustrates an embodiment wherein the latch arrangement 14 comprises two latch parts 23 and a wedge 24. The latch parts are pivotable attached to the inner arm (8B), and the both latch parts comprise a projection end 23A. The pivotable attachment can be achieved by a pin 23D and pin holes in the latch and in the inner part.

The wedge 24 is between the latch spring arrangement 15 and the latch parts 23. The inner arm has a recess 25 for the latch arrangement and the latch spring arrangement 15. The outer arm has side holes 26. The latch spring arrangement 15 is arranged via the wedge 24 to turn the projections towards the side holes 26 to be in the holding position, and to allow movement of the wedge and the latch parts for said release of the release device 10A.

The latch part 23 has a latch arm 23B, wherein the projection end 23A is at the transversal directions with respect to the latch arm's longitudinal direction, and the attachment to the inner arm 8B is at another end 23C of the latch arm.

In addition, the wedge may have means for guiding its movement. The means can pins 24A, which are attached to holes 24B on the wedge and being partly in guiding slots 24E formed on the inner arm 8B.

Figure 5:
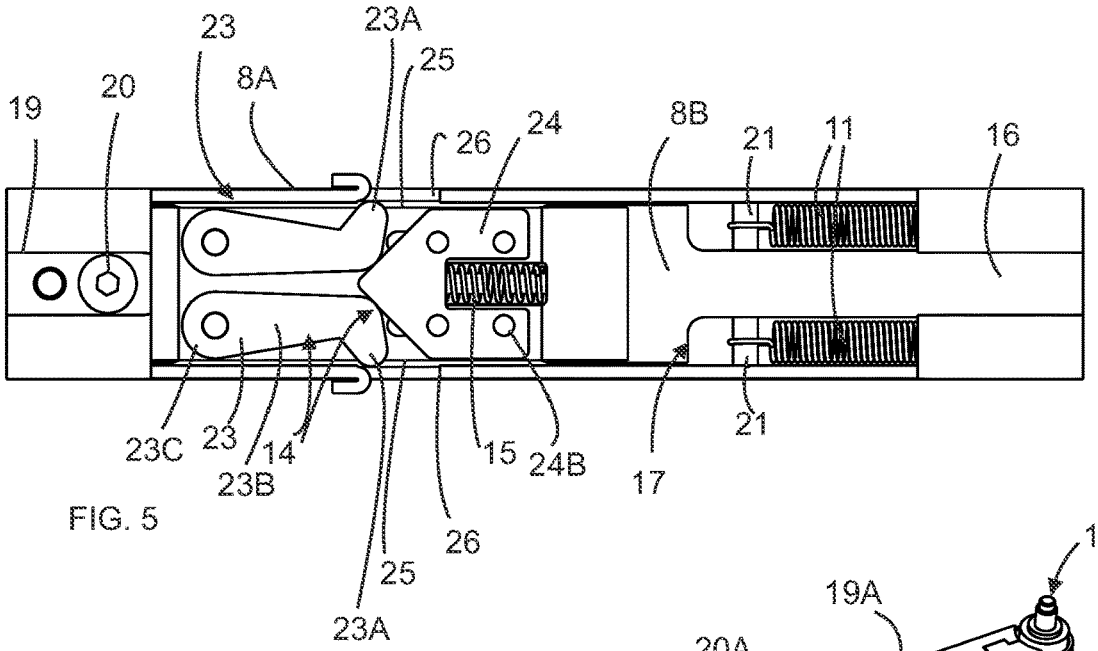
Figure 7:
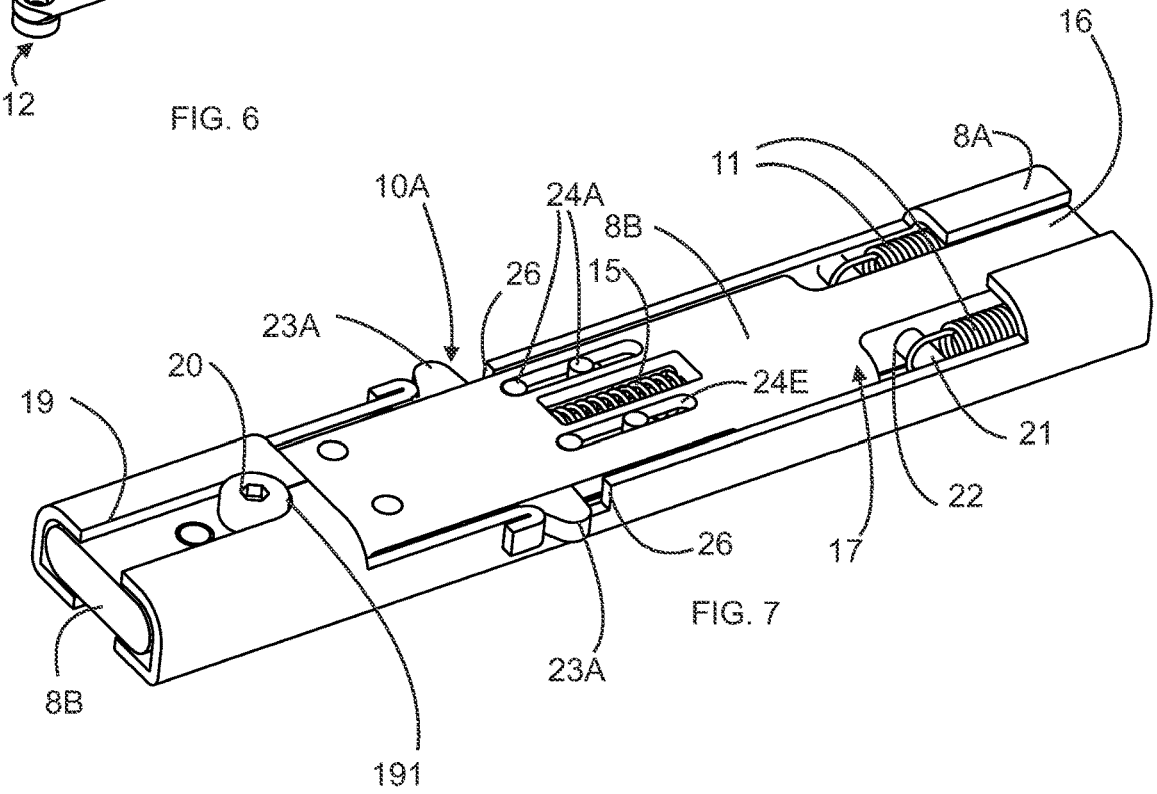
FIG. 7 illustrates yet another cut-away view of the arm of FIG. 3.

So, as can be seen, the latch spring arrangement 15 pushes the wedge towards the latch part in order to turn them towards the side holes 26. If an external force pulling the inner arm out from the outer arm is powerful enough, the latch parts moves towards the wedge in which case the latch spring arrangement is tensioned more. FIG. 5 shows this situation when the release device has been releases and so the inner arm can slide with respect to the outer arm. FIGS. 4 and 7 show the latch arrangement 14 and a latch spring arrangement 15 in the holding position.

FIGS. 8, 9, and 10 illustrates another embodiment wherein the latch arrangement comprises a latch 27, which is pivotable attached to the outer arm 9A. The inner arm 9B has a holding surface 28, and the latch 27 comprises a counter surface 29. The latch spring arrangement 15 is arranged to turn the latch in order that the counter surface 29 is towards the holding surface 28 to be in the holding position, and to allow movement of the latch 27 for said release of the release device 10B. The latch has an arm shape, and said attachment is at the first end 30 of the latch 27. The counter surface is at the second end 31 of the latch.

As seen in FIGS. 9 and 10, the inner arm has space, and one side of the space provides the holding surface 28. The latch spring arrangement 15 turns the latch towards the space in order to that the counter surface 29 is towards the holding surface.

If an external force pulling the inner arm out from the outer arm is powerful enough, the latch moves away from the space in which case the latch spring arrangement is tensioned more. FIG. 10 shows this situation when the release device has been releases and so the inner arm can slide with respect to the outer arm. FIG. 9 shows the latch arrangement 14 and a latch spring arrangement 15 in the holding position.

FIGS. 11-14 illustrate yet another embodiment of the arm 32 in the inventive arrangement. In this embodiment the latch arrangement 14 comprises two latch parts 34 and a wedge 35 having two wedge surfaces 35A. The inner arm 32B comprises a recess 36 wherein the latch parts 34 and the wedge are positioned. The recess has an extension 36A at the longitudinal direction of the inner arm, in which extension the latch spring arrangement 15 is positioned. The latch parts 34 are between the wedge surfaces 35A and counter surfaces 37 of the inner arm 32B. The outer arm 32A has side holes 26. The latch spring arrangement 15 is arranged via the wedge 35 to move the latch parts 34 towards the side holes 26 to be in the holding position, and to allow movement of the wedge 35 and the latch parts 34 for said release of the release device 10C.

The latch parts 34 can be rolls or balls. The recess 36 can have a U-form, and the wedge 35 has a corresponding form so that the wedge can slide in the U-form. Further, as can be seen in FIGS. 12-14, the inner arm 32B can have a corner structure having a transversal surface 38 with respect to the longitudinal direction of the inner arm 32B. The transversal surface is towards an inner bottom 39 of the wedge. FIG. 13 shows the inner arm 32B in the normal position, so the latch parts 34 are partly in the side holes 26. FIG. 14 shows the situation where the release device has bee released. The external force moving the inner arm 32B out from the outer arm 32A have pushed the latch parts 34 via the counter surfaces 37 of the inner arm 32B towards the wedge surfaces 35A, which has caused the movement of the wedge towards the latch spring arrangement 15, and the movement of the latch parts 34 away from the side walls into the recess 36. The inner arm has slightly moved out from the outer arm 32A in FIG. 14.

FIG. 15 illustrates another embodiment of the arm of FIG. 11. In this embodiment the side holes 26 are provided with a hole piece 40 that comprises a hole 41 and support extensions 42, 43 towards the inner arm. The latch parts are arranged to be partly in the holes 41 of the hole piece 40 in the normal position of the inner arm. The support extensions are used to fix the hole piece in the side hole 26. In addition, the support extensions provide contact surfaces for the latch parts. By using the hole pieces the material and the shape of the contacts against the latch parts can be conveniently formed in order to have desired properties. The hole pieces can be used with embodiments of the invention, like with the embodiments of FIGS. 3-10. It is worth to note that the wedge 35 in FIG. 15 is the similar than the wedge in FIGS. 12-14 but showed from the opposite side.

FIG. 16 illustrates yet another embodiment of the arm of FIG. 11. As already described the spring arrangement 11 of this embodiment comprises one spring, and the inner arm 32B comprises two longitudinal extensions 33 at an inside end 17 of the inner arm. The spring is situated between the two extensions. The spring arrangement of FIG. 16 can also be used with other embodiments.

As described above, the inventive arrangement makes it possible to open the door more than the door closer arrangement has been designed for the normal use without causing so much extra stress to the hold open device 4 as previous solutions. This has a direct impact to the lifetime of the hold open device. In addition, the use of the inventive arrangement is more comfortable than with the prior art solutions, because the hold open device is not overridden.

It is evident from the above that the invention is not limited to the embodiments described in this text but can be implemented utilizing many other different embodiments within the scope of the independent claims.

The invention claimed is:

1. A door closer arrangement, which comprises a door closer;

a slide rail, the slide rails being provided with a device configured to hold open a door; and an arm being connected to the door closer at a first end of the arm, and to the slide rail at a second end of the arm, the arm comprising:

an outer arm;

an inner arm situated partly inside the outer arm in a sliding manner;

a spring arrangement configured to hold the inner arm in the outer arm; and a release device arranged to release the inner arm when an external force being strong enough to activate a release of the release device drives the inner arm out from the outer arm, the release device comprising a latch arrangement and a latch spring arrangement, which are arranged to release the inner arm by said external force.

2. The door closer arrangement according to claim 1, wherein the spring arrangement comprises at least one spring.

3. The door closer arrangement according to claim 2, wherein the spring arrangement comprises one spring and the inner arm comprises two longitudinal extensions at an inside end of the inner arm, the spring being situated between the two extensions, a first end of the spring being connected to the inside end of the inner arm or to the longitudinal extensions and a second end of the spring being connected to the outer arm via a connection part.

4. A door closer arrangement according to claim 2, wherein the spring arrangement comprises two springs and the inner arm comprises a longitudinal extension at an inside end of the inner arm, the two springs being situated at both sides of the longitudinal extension, first ends of the two spring being connected to the inside end of the inner arm or to the extension, and second ends of the two spring being connected to the outer arm via a connection part.

5. The door closer arrangement according to claim 4, wherein the longitudinal extension has one guiding extension.

6. The door closer arrangement according to claim 1, wherein the inner arm comprises at least one guiding extension in a transversal direction with respect to a longitudinal axis of the inner arm, and the outer arm comprises at least one longitudinal hole, and wherein said guiding extension is situated.

7. The door closer arrangement according to claim 1, wherein the latch arrangement comprises two latch parts and a wedge, the two latch parts being pivotably attached to the inner arm, and the two latch parts comprising a projection end, the wedge being between the latch spring arrangement and the latch parts, an inner arm recess for the latch arrangement and the latch spring arrangement, and the outer arm having side holes, the latch spring arrangement being arranged via the wedge to turn the projections towards the side holes, and to allow movement of the wedge and the latch parts for said release of the release device.

8. The door closer arrangement according to claim 7, wherein the latch parts have a latch arm, and wherein the projection end is at the transversal directions with respect to a longitudinal direction of the latch arm, and said attachment to the inner arm being at another end of the latch arm.

9. The door closer arrangement according to claim 7, wherein each side hole is provided with a hole piece that comprises a hole and support extensions towards the inner arm.

10. The door closer arrangement according to claim 1, wherein latch arrangement comprises a latch being pivotable attached to the outer arm, the inner arm having a holding surface, and the latch comprises a counter surface, the latch spring arrangement being arranged to turn the latch in order that the counter surface is towards the holding surface to be in said holding position, and to allow movement of the latch for said release of the release device.

11. The door closer arrangement according to claim 10, wherein the latch has an arm shape, and said attachment being at a first end of the latch and the counter surface being at a second end of the latch.

12. The door closer arrangement according to claim 1, wherein the latch arrangement comprises two latch parts and a wedge having two wedge surfaces, the inner arm comprising a recess wherein the latch parts and the wedge are positioned, and the recess has an extension at the longitudinal direction of the inner arm, in which extension the latch spring arrangement is positioned, the latch parts being between the wedge surfaces and counter surfaces of the inner arm, and the outer arm having side holes, the latch spring arrangement being arranged via the wedge to move the latch parts towards the side holes to be in said holding position, and to allow movement of the wedge and the latch parts for said release of the release device.

13. The door closer arrangement according to claim 12, wherein the latch parts are rolls or balls.

14. The door closer arrangement according to claim 12, wherein the recess has a U-form, and the wedge has a corresponding form so that the wedge can slide in the U-form.

15. The door closer arrangement according to claim 14, wherein the inner arm has a corner structure having a transversal surface with respect to the longitudinal direction of the inner arm, the transversal surface being towards an inner bottom of the wedge.

* * * * *